US006267032B1

(12) United States Patent
Hsieh

(10) Patent No.: US 6,267,032 B1
(45) Date of Patent: Jul. 31, 2001

(54) TWIN-CAM DRIVE TYPE ADAPTER

(76) Inventor: Shih-Kuei Hsieh, No. 367-1 Pei Yang Road, Feng Yuan City, Taichung Hsien (TW)

( * ) Notice: Subject to any disclaimer, the term of this patent is extended or adjusted under 35 U.S.C. 154(b) by 0 days.

(21) Appl. No.: 09/593,139

(22) Filed: Jun. 14, 2000

(51) Int. Cl.[7] ..... B25B 23/16
(52) U.S. Cl. ..... 81/177.85; 81/177.2
(58) Field of Search ..... 81/177.85, 177.2; 403/323, 322.4, 330

(56) References Cited

U.S. PATENT DOCUMENTS

| | | | | |
|---|---|---|---|---|
| 4,614,457 | * | 9/1986 | Sammon | 81/177.85 |
| 4,781,085 | * | 11/1988 | Fox, III | 81/177.85 |
| 4,817,476 | * | 4/1989 | Karge | 81/177.85 |
| 5,390,571 | * | 2/1995 | Fox, III et al. | 81/177.85 |
| 6,003,414 | * | 12/1999 | Hsieh | 81/177.85 |
| 6,006,632 | * | 12/1999 | Hsieh | 81/177.85 |

* cited by examiner

*Primary Examiner*—Eileen P. Morgan
*Assistant Examiner*—Joni B. Danganan
(74) *Attorney, Agent, or Firm*—Dougherty & Troxell

(57) ABSTRACT

Twin-cam drive type adapter including: a main body the bottom end of which has a fitting section; a rotary bar the bar body of which is disposed with two cam sections, two releasing sections being formed between the two cam sections and interlaced with the cam sections, the two cam sections forming a largest radius on the rotary bar, while the releasing sections forming a smallest radius on the rotary bar, the rotary bar transversely passing through the adapter, the rotary bar having at least one rotary button disposed at one end thereof for a user's hand to rotate; a slide rod, a circumferential wall of the bottom end of the slide rod being formed with a dented section, the slide rod being up and down slidably fitted in the main body; a resilient member disposed between the main body and the slide rod, the resilient energy of the resilient member serving to keep pushing the slide rod upward; and a ball member received in the fitting section of the main body, the ball member being pushed by the slide rod to protrude out of the fitting section. When an operator rotates the rotary bar by a small angle, one of the cam sections depresses the slide rod, permitting the ball member to move into the dented section thereof.

6 Claims, 7 Drawing Sheets

TWIN-CAM DRIVE TYPE ADAPTER

BACKGROUND OF THE INVENTION

The present invention relates to a hand tool, and more particularly to an adapter for connecting the hand tool with a socket. The adapter has double cam sections so that a user can operate the adapter by small angle for engaging the adapter with the socket or releasing the socket.

A conventional wrench is often fitted with a socket for driving a nut. In order to fit with sockets with different sizes, the wrench is equipped an adapter. The adapter has a projecting post. A ball member is inlaid in a lateral wall face of the projecting post. A spring is disposed in the projecting post for pushing the ball member to partially protrude out of the projecting post. When the projecting post is fitted with the socket, the ball member abuts against the inner wall of the socket to prevent the socket from detaching from the adapter. However, in the case that the spring has greater resilience, it is necessary for a user to exert a greater force for fitting or taking off the socket. In the case that the spring has less resilience, the ball member will be unable to effectively hold the socket and the socket is likely to detach from the adapter.

In order to solve the above problem, an improved adapter has been proposed. Referring to FIGS. 1 and 2, the adapter 10 includes: a main body 12 formed with an axial fitting hole 13 and a shaft hole 14; a pressing rod 15 fitted in the shaft hole 14 and upward pushed by a spring 16, the wall face of the pressing rod 15 being formed with a concave section 17; a rotary bar 18 transversely passing through the main body 12 and having a rotary button 19, the rotary button 19 being manually rotatable for turning the rotary bar 18, the body of the rotary bar 18 being formed with a cam section 20; and a ball member 22 positioned in a through hole 24 of the main body and pushed by the pressing rod to protrude out of a projecting post 25 of the bottom end of the main body.

In use, the projecting post 25 is fitted with the socket. As shown in FIG. 2, the pressing rod 15 is positioned at an upper dead end and free from the pressing of the cam section 20. At this time, the ball member 22 abuts against the inner wall of the socket without retraction so that the socket is effectively held. When taking off or fitting the socket, the rotary button 19 is rotated to turn the rotary bar 18. As shown in FIG. 3, the cam section 20 presses down the pressing rod 15 to slide downward. At this time, the ball member 22 can move into the concave section 17 and retract into the through hole 24. Under such circumstance, the socket is no more engaged with the ball member and can be taken off.

According to the above arrangement, a user can operate and control the position of the ball member so as to facilitate taking off or fitting of the socket and thus solve the problem of the conventional adapter. However, such structure still has some shortcomings as follows:

First, as shown in FIG. 3, only when the cam section is faced downward, is the pressing rod pressed down by the rotary bar to release the socket. While at other angular positions, the rotary bar is unable to press down the pressing rod. When a user rotates the rotary bar 18 to leave the position of FIG. 3, the cam section 20 no more presses down the pressing rod 15. After the rotary bar is released, the rotarybar can be positioned at any angular position. FIGS. 4 and 5 show two of these angular positions. In FIG. 4, a user needs to clockwise rotate the rotary bar by 270 degrees for making the cam section press down the pressing rod. In FIG. 5, no matter the user clockwise or counterclockwise rotates the rotary bar, the user must rotate the rotary bar by 180 degrees to depress the pressing rod. Therefore, with such structure, it is necessary to rotate the rotary bar by large angle for depressing the pressing rod. Such operation is inconvenient for a user to perform.

Second, when the pressing rod is positioned at the upper dead end, the rotary bar may be positioned at any angular position. In other words, the rotary bar has no specific location point. Therefore, it is hard for a user to know by how many degrees the rotary bar should be rotated for pressing down the pressing rod.

In addition, in the conventional structure, the rotary button 19 protrudes from the main body 12. A user often incautiously gets injured by the protruding rotary button 19.

SUMMARY OF THE INVENTION

It is therefore a primary object of the present invention to provide a twin-cam drive type adapter for connecting a hand tool with a socket. The adapter has double cam sections and can be conveniently operated by a small angle.

It is a further object of the present invention to provide the above adapter in which when the slide rod is not depressed by the rotary bar, the rotary bar is specific at a location point.

It is still a further object of the present invention to provide the above adapter in which the rotary button of the rotary bar does not protrude from the main body of the adapter so that the possibility of injury to an operator during operation is minimized.

The present invention can be best understood through the following description and accompanying drawings wherein:

DETAILED DESCRIPTION OF THE PREFERRED EMBODIMENTS

Figure 1:
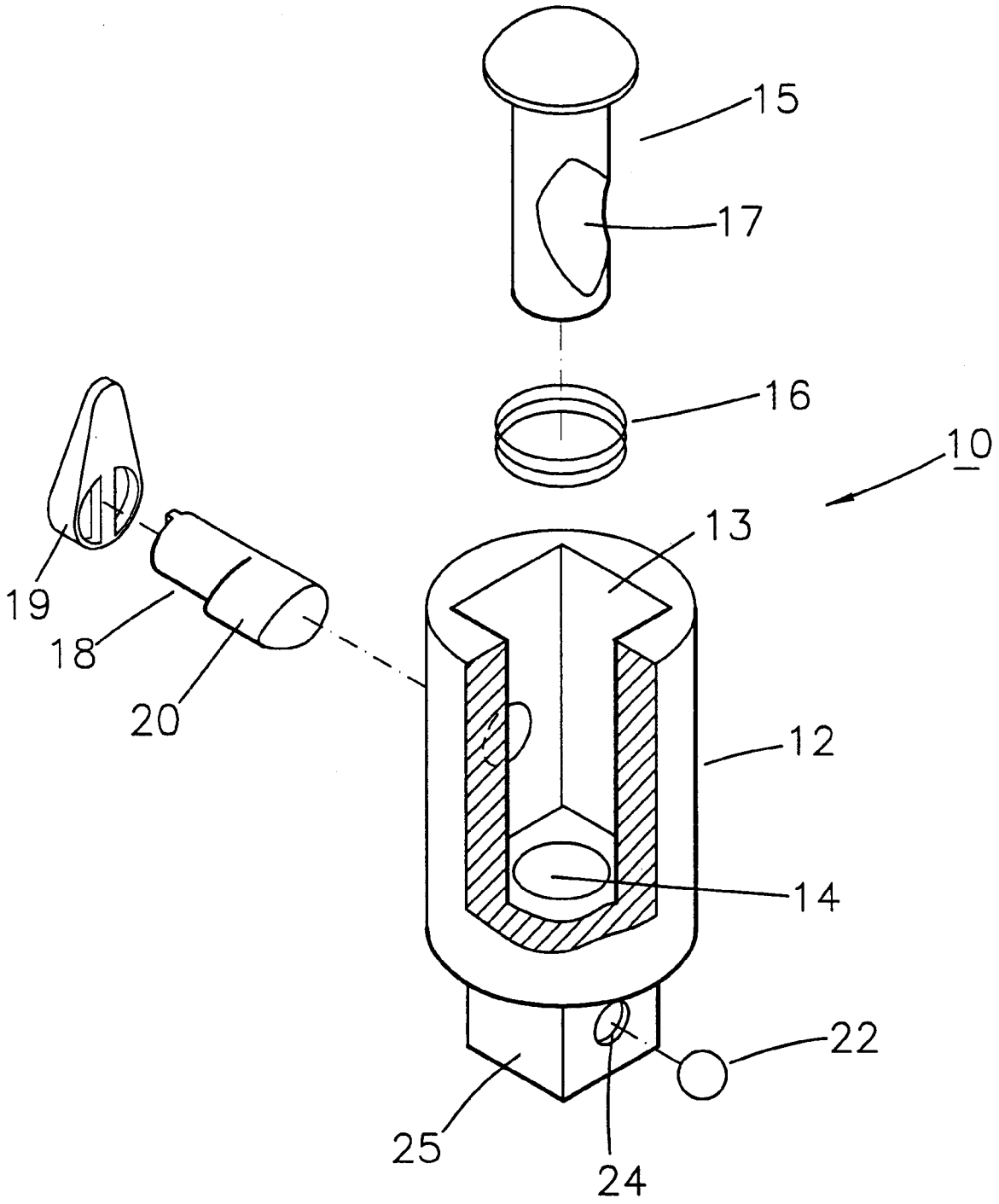
FIG. 1 PRIOR ART
FIG. 1 is a perspective exploded and partially section view of a conventional adapter.
Figure 2:
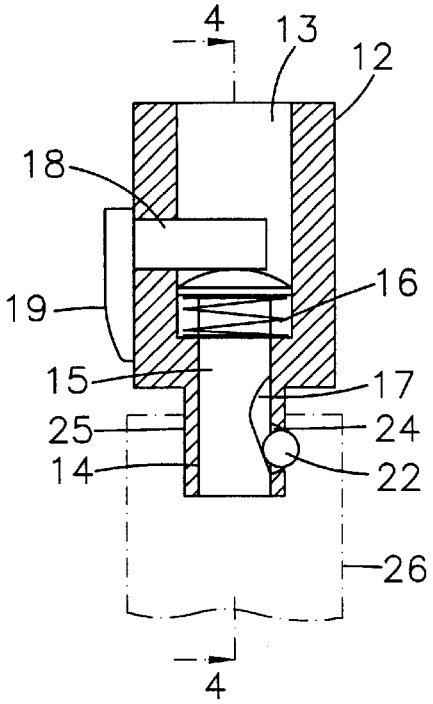
FIG. 2 PRIOR ART
FIG. 2 is a longitudinal sectional assembled view according to FIG. 1.
Figure 3:
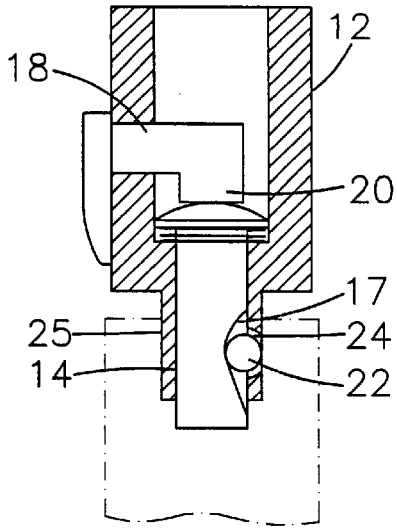
FIG. 3 PRIOR ART
FIG. 3 is a longitudinal sectional assembled view according to FIG. 2, showing another operation state of the conventional adapter.
Figure 4:
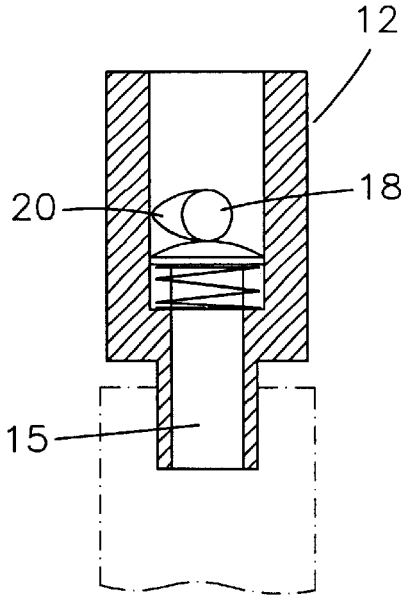
FIG. 4 PRIOR ART
FIG. 4 is a sectional view taken along line 4—4 of FIG. 2.
Figure 5:
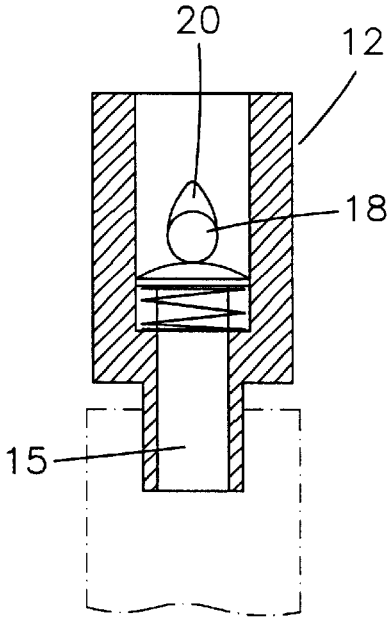
FIG. 5 PRIOR ART
FIG. 5 is a longitudinal sectional view according to FIG. 4, showing the rotary bar at another angle.
Figure 6:
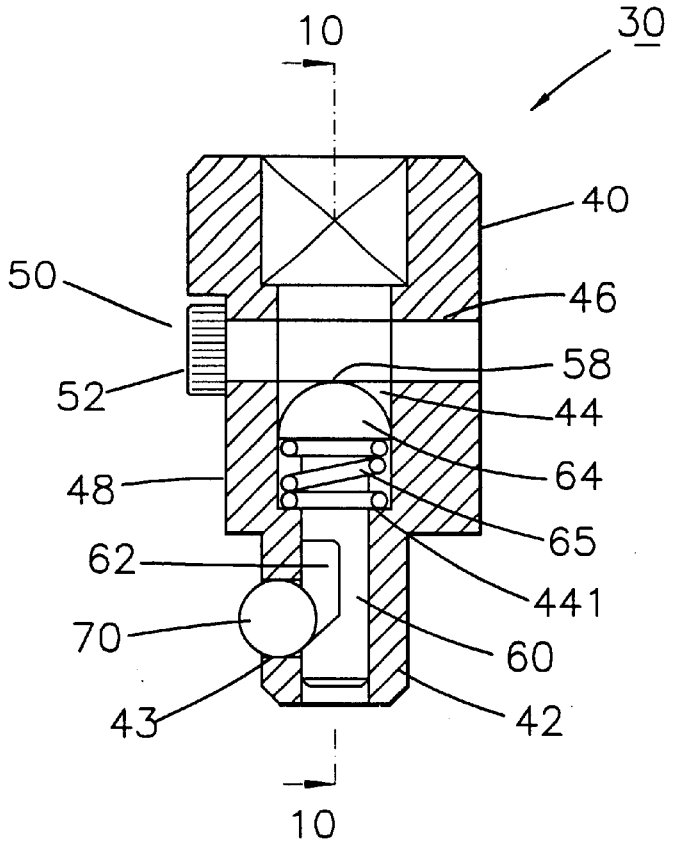
FIG. 6 is a longitudinal sectional view of a first embodiment of the present invention, showing that the ball member protrudes from the fitting section for abutting against a socket.
Figure 7:
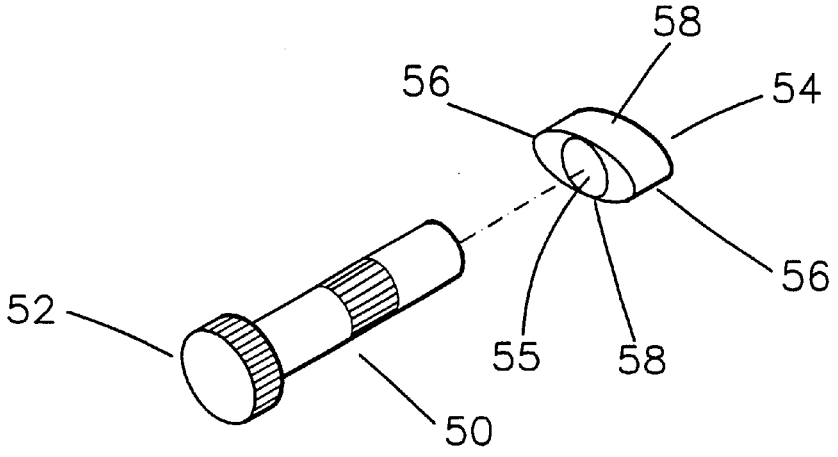
FIG. 7 is a perspective view of the rotary bar of FIG. 6.

Please refer to FIGS. 6 and 7. According to a first embodiment, the adapter 30 of the present invention includes:

a column-shaped main body 40 the bottom end of which has a projecting post-like fitting section 42 with smaller outer diameter, the main body 40 being formed with an axial shaft hole 44 passing through the fitting section 42;

a rotary bar 50 having a rotary button 52 at one end, the rotary bar 50 having a cam 54 with an elliptic cross-section, whereby two sides of the cam 54 being respectively formed with two cam sections, the cam 54 having a hole 55 in which the body of the rotary bar 50 is fixedly, whereby the rotary bar 50 has two radial cam sections 56 at 180 degree interval and has two releasing sections 58 positioned between the cam sections also at 180 degree interval, the two cam sections forming a largest radius on the rotary bar, while the releasing sections forming a smallest radius on the rotary bar, the interconnecting line of the two cam sections and the interconnecting line of the two releasing sections being normal to each other, the rotary bar 50 rotatably passing through a radial pivot hole 46 of the main body 40, the cam sections 56 and the releasing sections 58 being positioned in the shaft hole 44, the rotary button 52 being positioned outside the main body for a user's hand to rotate, the rotary button 52 being positioned in a recessed section 48 of the outer wall of the main body without protruding from the maximum outer diameter of the main body;

a slide rod 60, a circumferential wall of the bottom end of the slide rod 60 being formed with an indented section 62, the slide rod being up and down slidably fitted in the shaft hole 44, a spring 65 being fitted on the slide rod 60, one end of the spring 65 abutting against a shoulder section 441 formed on inner wall of the shaft hole 44, while the other end of the spring 65 abutting against a head section 64 at top end of the slide rod, the spring 65 resiliently upward pushing the slide rod to make the top end thereof abut against the rotary bar; and a ball member 70 received in a radial through hole 43 formed on the fitting section 42 of the main body without detaching therefrom, the ball member corresponding to the indented section 62 of the slide rod.

Figure 8:
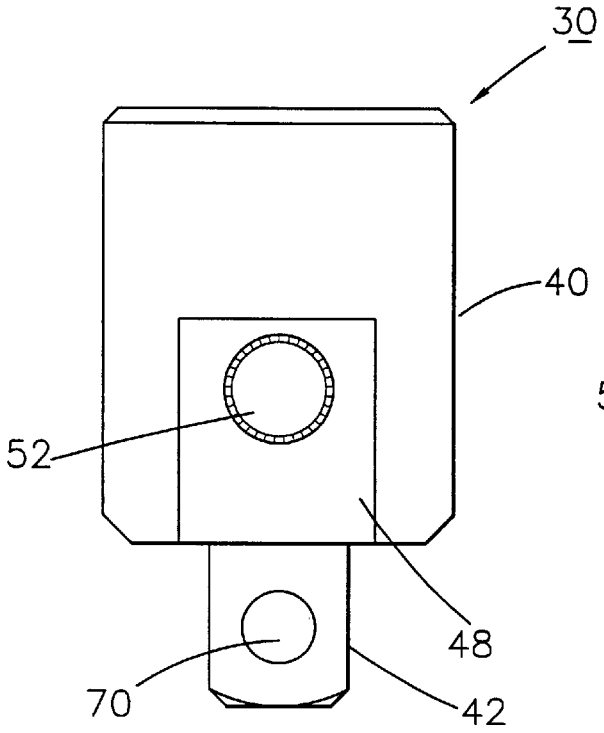
FIG. 8 is a side view of FIG. 6.
Figure 10:
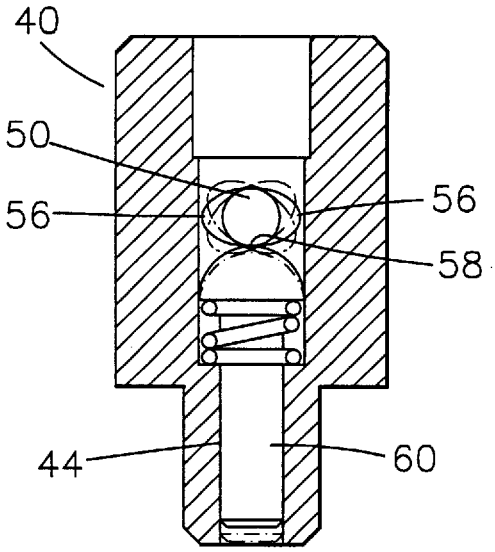
FIG. 10 is a sectional view taken along line 10—10 of FIG. 6.

In use, as shown in FIG. 8, an operator from an outer side of the main body rotates the rotary button 52 for turning the rotary bar 50. When the rotary bar is positioned at the positions of FIGS. 6 and 10, a releasing section 58 abuts against the slide rod 60. At this time, the slide rod is positioned at an upper dead end and the bottom end of the slide rod outwardly pushes the ball member 70 to make the ball member protrude out of the fitting section 42. Under such circumstance, the ball member is engaged in a recess formed on an inner wall of the socket to prevent the socket from detaching from the fitting section.

Figure 9:
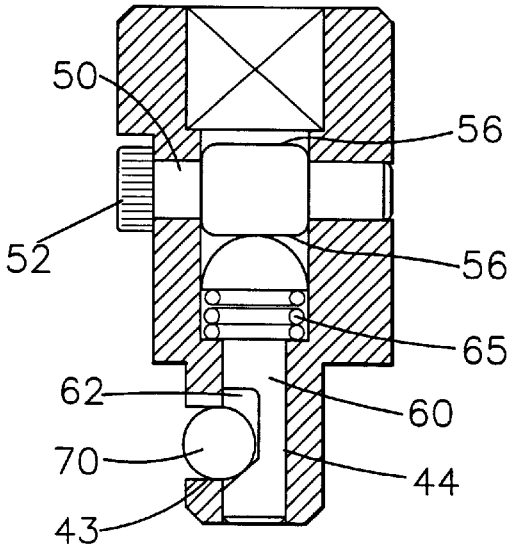
FIG. 9 is a view according to FIG. 6, showing a releasing state of the adapter of the present invention.

When the operator rotates the rotary bar 50 to a position as shown in FIG. 9, one cam section 56 depresses the slide rod 60 and makes the slide rod 60 move downward. At this time, the indented section 62 is aligned with the ball member 70, whereby the ball member can be moved inward into the indented section 62 and be disengaged from the inner wall of the socket. Under such circumstance, the operator can take off or fit on the socket. After the rotary bar is released from the rotating force, the rotary bar is restored to its home position of FIG. 6.

FIGS. 11 to 16 show other preferred embodiments of the present invention.

Figure 11:
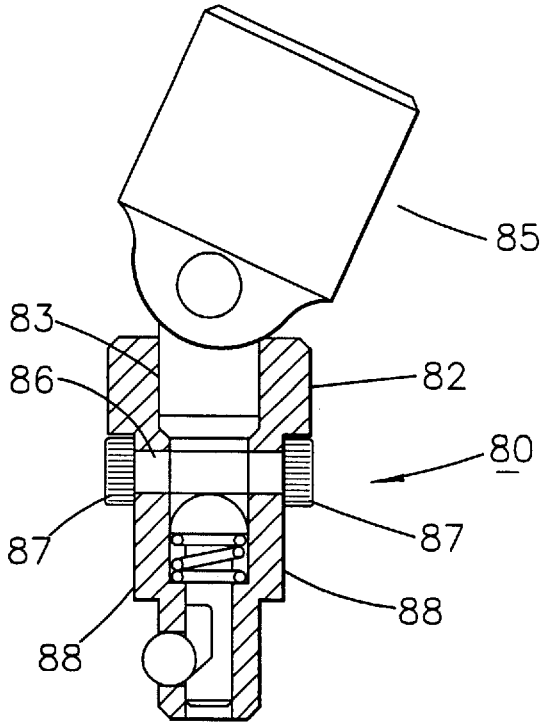
FIG. 11 is a longitudinal sectional view of a second embodiment of the present invention.

In FIG. 11, the adapter 80 has a structure substantially identical to that of the first embodiment. The difference therebetween resides in that the top end of the main body 82 is formed with a fitting socket 83 for fitting with a suitable hand tool 85. Each end of the rotary bar 86 is disposed with a rotary button 87 positioned in a recessed section 88 formed on each side of the main body. Therefore, a user can rotate the rotary bar from either side of the main body.

Figure 12:
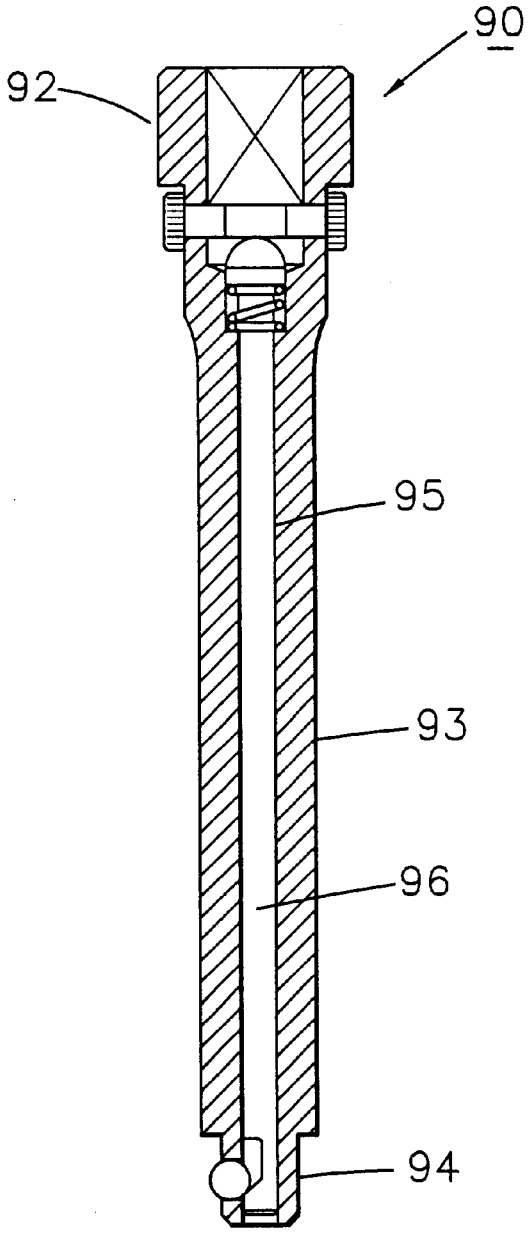
FIG. 12 is a longitudinal sectional view of a third embodiment of the present invention, showing an engaging state thereof.

In FIG. 12, the adapter 90 is formed with an axially elongated stem section 93. A free end of the stem section 93 is disposed with a fitting section 94. A shaft hole 95 axially extends through the main body 92, stem section 93 and the fitting section 94. The slide rod 96 is also elongated. The operation of this embodiment is identical to that of the above embodiment.

Figure 13:
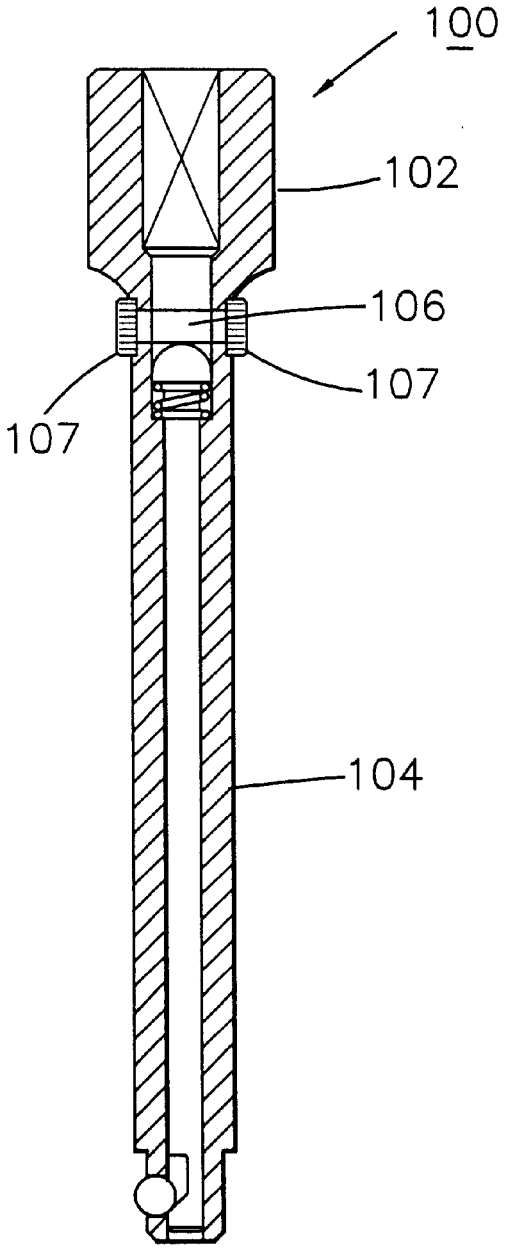
FIG. 13 is a longitudinal sectional view of a fourth embodiment of the present invention.

In FIG. 13, the adapter 100 has a structure substantially identical to that of the embodiment of FIG. 12. The difference therebetween resides in that the rotary bar is pivotally disposed on the elongated stem section 104 rather than the main body 102. The stem section 104 has an outer diameter smaller than that of the main body 102 so that the rotary buttons 107 also do not protrude from the main body.

Figure 14:
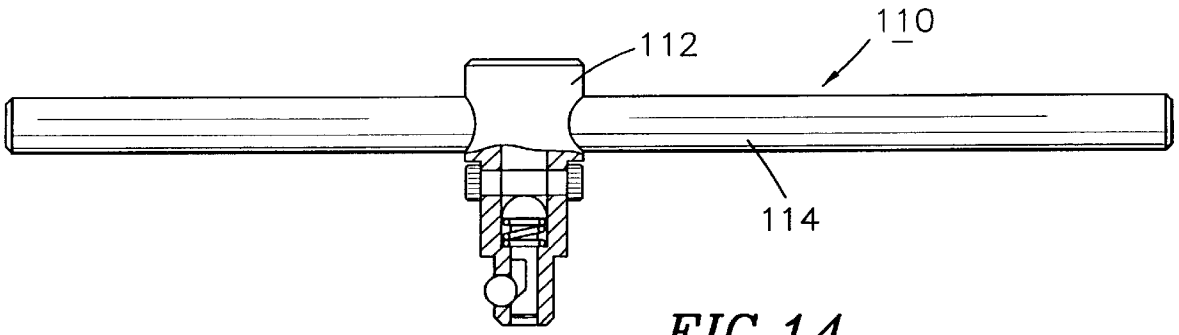
FIG. 14 is a longitudinal partially sectional view of a fifth embodiment of the present invention.

In FIG. 14, a rod body 114 transversely passes through the top end of the main body 112 of the adapter 110 to form a hand tool.

Figure 15:
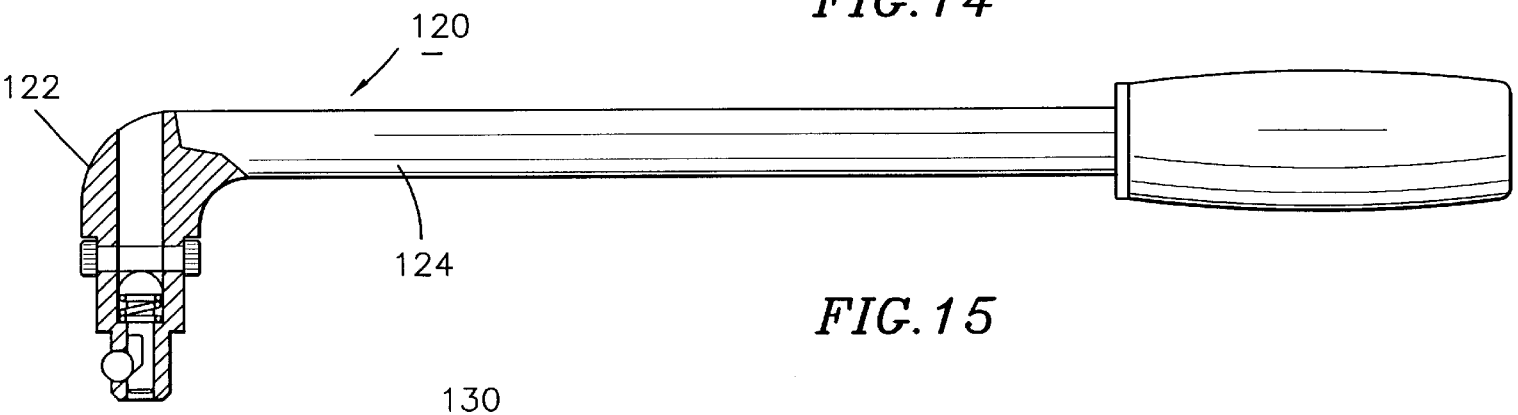
FIG. 15 is a longitudinal partially sectional view of a sixth embodiment of the present invention.

In FIG. 15, an elongated stem body 124 transversely integrally extends from the top end of the main body 122 of the adapter 120 to form a fixed type wrench.

Figure 16:
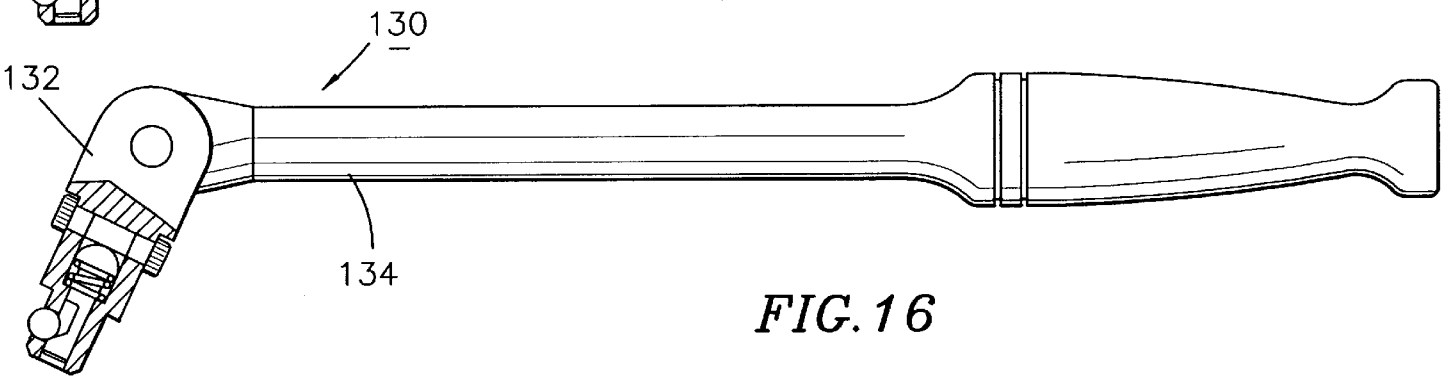
FIG. 16 is a longitudinal partially sectional view of a seventh embodiment of the present invention.

In FIG. 16, an elongated stem body 134 is pivotally connected with the top end of the main body 132 of the adapter 130 to form a rotary wrench.

The present invention has the following advantages:

1. According to FIG. 10, the rotary bar of the present invention is disposed with double cam sections. Therefore, no matter if the rotary bar is clockwise or counterclockwise rotated, a user only needs to rotate the rotary bar by 90 degrees to make one of the cam sections press down the slide rod for disengaging the ball member from the socket. Accordingly, the user only needs to turn the rotary button by a small angle so that the operation is facilitated. Furthermore, in any direction, the user only needs to turn the rotary bar by about 30 degrees as shown by the phantom line, the diverging arch face of the cam section starts to depress the slide rod. Therefore, the slide rod is operated by means of rotating the rotary bar by small angle so that the slide rod is operated at high sensitivity.

2. When the operator rotates the rotary bar from the released state of FIG. 9 to the engaged state of FIGS. 6 and 10, in any rotational direction, the user only needs to turn the rotary bar by a small angle for making the tip of the cam section 56 leave the top end of the slide rod 60. Thereafter, a force arm is produced between the cam section and the top end of the slide rod. When the resilient energy reserved in the spring pushes the slide rod to move upward, the slide rod will exert a force onto the cam section. Therefore, the rotary bar will rotate and automatically restore to the position of FIGS. 6 and 10 where one of the releasing sections 58 is located at the top end of the slide rod. Accordingly, one of the releasing sections of the rotary bar can be automatically located at the top end of the slide rod as a specific location point. Therefore, no matter if the rotary bar is clockwise or counterclockwise rotated, the operator only needs to rotate the rotary bar by 90 degrees for precisely pressing down the slide rod.

3. The rotary button will not protrude from the main body. Therefore, the possibility of hit and injury of an operator during operation is minimized and the safety in operation can be ensured.

The above embodiments are only used to illustrate the present invention, not intended to limit the scope thereof. Many modifications of the above embodiments can be made without departing from the spirit of the present invention.

What is claimed is:

1. A socket adapter with a twin cam drive and comprising:

a) a main body having: a fitting section protruding from one end thereof; an axial shaft hole passing through the fitting section and into the main body; and an outer surface with at least one recessed section therein;

b) a slide rod slidably located in the axial shaft hole, the slide rod having a head section and an indented section;

c) a ball member movably mounted in the fitting section and aligned with the indented section whereby movement of the slide rod within the axial shaft hole moves the ball member between extended and retracted positions;

d) a rotary bar extending transversely through the axial shaft hole and mounted so as to rotate about a longitudinal axis, the rotary bar having twin cams extending outwardly therefrom in opposite directions and located within the axial shaft hole, the twin cams oriented 180° apart, the rotary bar having at least one button located in the at least one recessed section such that the at least one button does not protrude outwardly beyond the outer surface of the main body; and, e) a spring acting on the slide rod so as to bias the head portion into contact with the twin cams such that rotation of the rotary bar through 90° in either direction moves the slide rod causing the ball member to move between the extended and retracted position.

2. The socket adapter of claim 1 wherein the twin cams have an elliptical configuration.

3. The socket adapter of claim 1 wherein the outer surface of the main body has two recessed sections and the rotary bar has two buttons, one button being located in each recessed section.

4. The socket adapter of claim 1 wherein the main body includes an axially elongated stem section, with the fitting section protruding from one end thereof.

5. The socket adapter of claim 4 wherein the rotary bar is rotatably mounted in the stem section.

6. The socket adapter of claim 1 wherein the rotary bar is rotatably mounted in the main body.

* * * * *